US011473180B2

(12) United States Patent
Yoshitomi et al.

(10) Patent No.: US 11,473,180 B2
(45) Date of Patent: Oct. 18, 2022

(54) HIGH-YIELD-RATIO HIGH-STRENGTH GALVANIZED STEEL SHEET AND METHOD FOR MANUFACTURING THE SAME

(71) Applicant: JFE Steel Corporation, Tokyo (JP)

(72) Inventors: Hiromi Yoshitomi, Tokyo (JP); Hiroyuki Masuoka, Tokyo (JP); Seisuke Tsuda, Tokyo (JP); Yasuhiro Nishimura, Tokyo (JP); Masaki Koba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 217 days.

(21) Appl. No.: 16/072,668

(22) PCT Filed: Jan. 26, 2017

(86) PCT No.: PCT/JP2017/002617
§ 371 (c)(1),
(2) Date: Jul. 25, 2018

(87) PCT Pub. No.: WO2017/131056
PCT Pub. Date: Aug. 3, 2017

(65) Prior Publication Data

US 2019/0032187 A1 Jan. 31, 2019

(30) Foreign Application Priority Data

Jan. 27, 2016 (JP) ..... JP2016-013206

(51) Int. Cl.
*C23C 2/06* (2006.01)
*C23C 2/02* (2006.01)
(Continued)

(52) U.S. Cl.
CPC ..... *C23C 2/06* (2013.01); *C21D 8/0247* (2013.01); *C21D 9/46* (2013.01); *C22C 38/00* (2013.01);
(Continued)

(58) Field of Classification Search
CPC ..... C23C 2/06; C21D 8/0247; C21D 9/46; C22C 38/00
See application file for complete search history.

(56) References Cited

U.S. PATENT DOCUMENTS 8,133,330 B2 3/2012 Futamura et al.
9,611,524 B2 4/2017 Hamada et al.
(Continued)

FOREIGN PATENT DOCUMENTS

CN 101583734 A 11/2009
CN 104204256 A 12/2014
(Continued)

OTHER PUBLICATIONS

Korean Office Action for Korean Application No. 10-2018-7021587, dated Feb. 26, 2020 with Concise Statement of Relevance of Office Action, 6 pages.
(Continued)

*Primary Examiner* — Robert S Jones, Jr.
*Assistant Examiner* — Jiangtian Xu
(74) *Attorney, Agent, or Firm* — RatnerPrestia

(57) ABSTRACT

Provided are a high-yield-ratio high-strength galvanized steel sheet and a method for manufacturing thereof. The high-yield-ratio high-strength galvanized steel sheet has a steel sheet having a specified chemical composition and a metallographic structure including, in terms of area ratio, in terms of area ratio, 15% or less of ferrite, 20% or more and 50% or less of martensite, and bainite and tempered martensite in a total amount of 30% or more, and a galvanized
(Continued)

layer formed on the steel sheet having a coating weight of 20 $g/m^2$ to 120 $g/m^2$ per side, in which a yield strength ratio is 65% or more, a tensile strength is 950 MPa or more, and Mn oxides are contained in the galvanized layer in an amount of 0.015 $g/m^2$ to 0.050 $g/m^2$.

4 Claims, 1 Drawing Sheet

(51) Int. Cl.

| | |
|---|---|
| ***C23C 2/28*** | (2006.01) |
| ***C23C 2/40*** | (2006.01) |
| ***C21D 9/46*** | (2006.01) |
| ***C22C 38/14*** | (2006.01) |
| ***C22C 38/60*** | (2006.01) |
| ***C22C 38/00*** | (2006.01) |
| ***C21D 8/02*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C22C 38/60* (2013.01); *C23C 2/02* (2013.01); *C23C 2/28* (2013.01); *C23C 2/40* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2009/0297881 | A1* | 12/2009 | Maalman | C23C 2/34 428/659 |
| 2013/0153096 | A1 | 6/2013 | Hamada et al. | |
| 2014/0234657 | A1* | 8/2014 | Azuma | C22C 38/001 428/659 |
| 2014/0322559 | A1* | 10/2014 | Becker | C23C 2/02 428/659 |
| 2015/0027593 | A1* | 1/2015 | Hata | C22C 38/26 148/504 |
| 2015/0111064 | A1 | 4/2015 | Ikeda et al. | |
| 2016/0160335 | A1* | 6/2016 | Ikeda | C21D 6/008 428/629 |
| 2017/0037488 | A1* | 2/2017 | Hasegawa | C21D 6/008 |
| 2017/0159151 | A1 | 6/2017 | Aoyama et al. | |
| 2018/0298462 | A1* | 10/2018 | Sano | C22C 38/00 |
| 2019/0078188 | A1 | 3/2019 | Ikeda et al. | |
| 2021/0115529 | A1* | 4/2021 | Yoshitomi | C22C 38/14 |

FOREIGN PATENT DOCUMENTS

| | | | | |
|---|---|---|---|---|
| CN | 105051238 | A | | 11/2015 |
| EP | 2112247 | A1 | | 10/2009 |
| EP | 2415896 | A1 | | 2/2012 |
| EP | 2623629 | A1 | | 8/2013 |
| EP | 2762590 | A1 | | 8/2014 |
| EP | 2881481 | A1 | | 6/2015 |
| EP | 2980259 | A1 | | 2/2016 |
| EP | 3054025 | A1 | | 8/2016 |
| EP | 3085802 | A1 | | 10/2016 |
| EP | 3106528 | A1 | | 12/2016 |
| JP | 2006265578 | A | * | 10/2006 |
| JP | 3956550 | B2 | | 8/2007 |
| JP | 2007211279 | A | | 8/2007 |
| JP | 2010065314 | A | | 3/2010 |
| JP | 2011117041 | A | | 6/2011 |
| JP | 2013147736 | A | | 8/2013 |
| JP | 2013213232 | A | | 10/2013 |
| JP | 5438302 | B2 | | 3/2014 |
| JP | 2015117403 | A | | 6/2015 |
| JP | 2015151607 | A | | 8/2015 |
| WO | 2013146606 | A | | 10/2013 |
| WO | 2015093043 | A1 | | 6/2015 |
| WO | 2015162849 | A1 | | 10/2015 |
| WO | 2016002141 | A1 | | 1/2016 |

OTHER PUBLICATIONS

International Search Report and Written Opinion for International Application No. PCT/JP2017/002617, dated May 9, 2017—5 pages.
Chinese Office Action with Search Report for Chinese Application No. 201780008414.0, dated Sep. 10, 2019, 9 pages.
Extended European Search Report for European Application No. 17 744 286.0, dated Nov. 30, 2018, 7 pages.
Korean Grant of Patent for Korean Application No. 10-2018-7021587, dated Aug. 19, 2020 with translation, 3 pages.

* cited by examiner

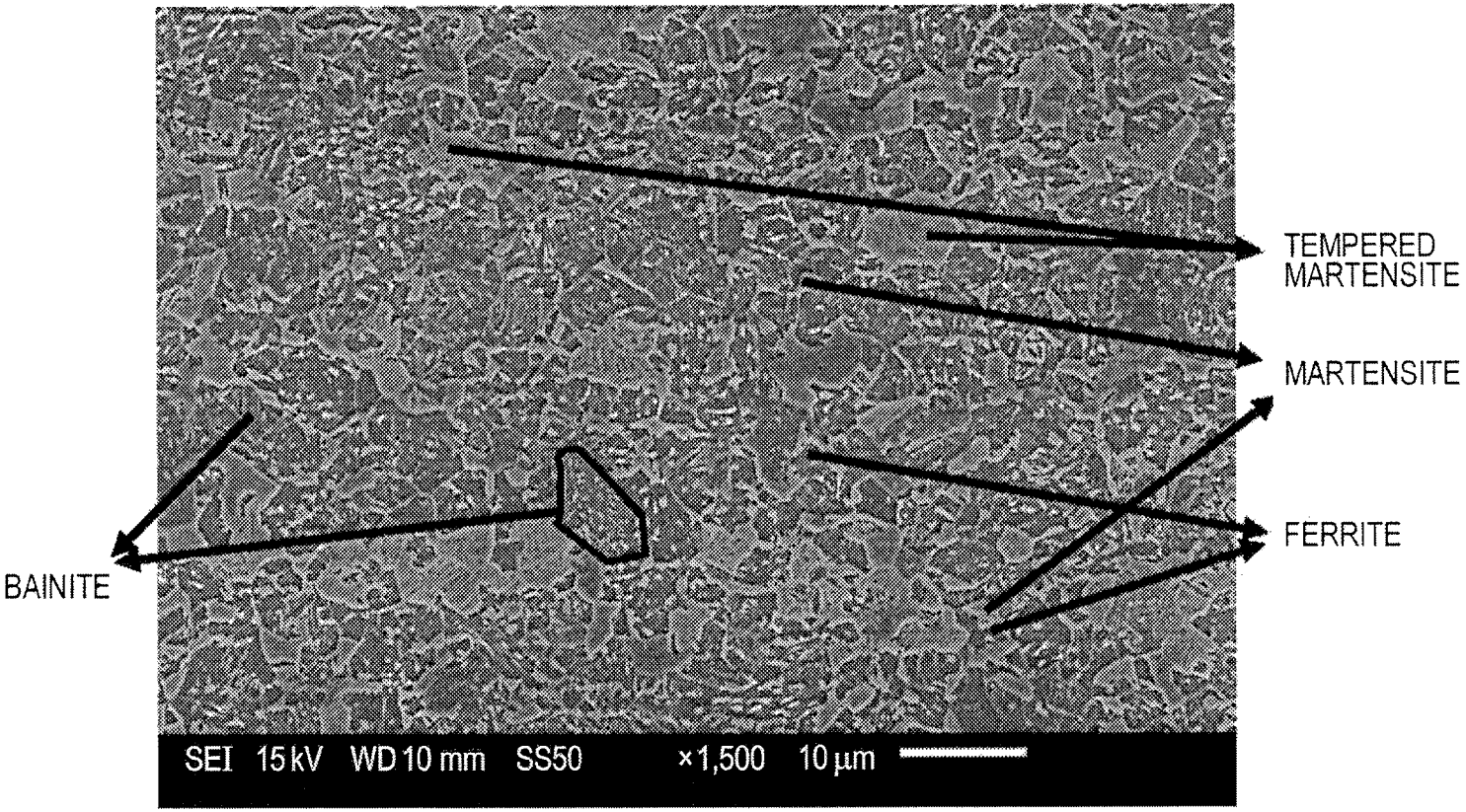
TEMPERED MARTENSITE
MARTENSITE
FERRITE
BAINITE
SEI 15 kV WD 10 mm SS50 ×1,500 10 µm

HIGH-YIELD-RATIO HIGH-STRENGTH GALVANIZED STEEL SHEET AND METHOD FOR MANUFACTURING THE SAME

CROSS REFERENCE TO RELATED APPLICATIONS

This is the U.S. National Phase application of PCT/JP2017/002617, filed Jan. 26, 2017, which claims priority to Japanese Patent Application No. 2016-013206, filed Jan. 27, 2016, the disclosures of each of these applications being incorporated herein by reference in their entireties for all purposes.

FIELD OF THE INVENTION

The present invention relates to a high-yield-ratio high-strength galvanized steel sheet excellent in terms of coating appearance, exfoliation resistance when bending is performed, and bending workability, whose base material is a steel sheet containing Si and Mn and which can preferably be used for collision-resistant parts of an automobile, and to a method for manufacturing the same.

BACKGROUND OF THE INVENTION

Nowadays, since there is a strong demand for improving the collision safety and fuel efficiency of an automobile, there is a growing trend toward improving the strength of thin steel sheets, which are materials for automotive parts. In particular, from the viewpoint of ensuring occupant safety at the time of an automotive collision, materials used for parts around a cabin are required to have a high yield strength ratio (YR:YR=(YS(yield strength)/TS(tensile strength))×100%). Since there is a risk of an increase in a load placed on a pressing machine, and since it is not possible to provide an ultrahigh-strength steel sheet with high ductility or stretch flange formability, processing performed on such parts involves mainly bending work. Therefore, the kind of required workability which is important in such a case is bendability.

Moreover, since automobiles are used for various purposes in various regions and types of weather due to automobiles being prevalent on a global scale, steel sheets, which are the materials for parts, are required to have a high rust prevention capability. Therefore, coated steel sheets are preferably used.

In addition, steel sheets having a high yield ratio have been developed conventionally. For example, Patent Literature 1 discloses a hot-dip galvanized steel sheet having a high yield ratio and a high strength excellent in terms of workability and a method for manufacturing the steel sheet. In addition, Patent Literature 2 discloses a steel sheet having a tensile strength of 980 MPa or more, a high yield ratio, and excellent workability (particularly, strength-ductility balance). In addition, Patent Literature 3 discloses a high-strength galvanized steel sheet excellent in terms of coating appearance, corrosion resistance, and exfoliation resistance when bending is performed, and bending workability, whose base material is a high-strength steel sheet containing Si and Mn, and a method for manufacturing the steel sheet.

PATENT LITERATURE

PTL 1: Japanese Patent No. 5438302

PTL 2: Japanese Unexamined Patent Application Publication No. 2013-213232

PTL 3: Japanese Unexamined Patent Application Publication No. 2015-151607

SUMMARY OF THE INVENTION

In the case of the technique according to Patent Literature 1, coating quality tends to deteriorate, and a solution thereof is not disclosed.

In the case of the technique according to Patent Literature 2, since sufficient consideration is not given to coatability, there is an insufficient improvement in coatability.

In the case of the technique according to Patent Literature 3, in an annealing process before a coating process, the hydrogen concentration in a furnace atmosphere is limited to be 20 vol % or more, and the annealing temperature is limited to be 600° C. to 700° C. Therefore, it is not possible to use the technique according to Patent Literature 3 for a material having an Ac3 point of higher than 800° C. from the viewpoint of a metallographic structure. Therefore, it is difficult to say that such a technique can preferably be used for the collision-resistant parts of an automobile.

The present invention has been completed in order to solve the problems described above, and an object of the present invention is to provide a high-yield-ratio high-strength galvanized steel sheet excellent in terms of coating appearance, exfoliation resistance when bending is performed, and bending workability, whose base material is a steel sheet containing Si and Mn and which can preferably be used for collision-resistant parts of an automobile, and a method for manufacturing the steel sheet.

The present inventors, in order to solve the problems described above, diligently conducted investigations of various thin steel sheets regarding the relationship between tensile strength (TS) and yield strength (YS) and regarding a method for simultaneously achieving improved workability and improved coatability and, as a result, found that it is possible to obtain a steel sheet which can preferably be used for collision-resistant parts and which simultaneously has improved workability and improved coatability by appropriately controlling the chemical composition and metallographic structure of a steel sheet and manufacturing conditions such as a temperature range and a furnace atmosphere when a heat treatment is performed. Specifically, exemplary embodiments of the present invention provide the following.

[1] A high-yield-ratio high-strength galvanized steel sheet having a steel sheet having a composition containing, by mass %, C: 0.12% or more and 0.25% or less, Si: less than 1%, Mn: 2.0% or more and 3% or less, P: 0.05% or less, S: 0.005% or less, Al: 0.1% or less, N: 0.008% or less, Ca: 0.0003% or less, one or more of Ti, Nb, V, and Zr in a total amount of 0.01% to 0.1%, and the balance being Fe and inevitable impurities, and a metallographic structure including, in terms of area ratio, 15% or less of ferrite, 20% or more and 50% or less of martensite, and bainite and tempered martensite in a total amount of 30% or more, and a galvanized layer formed on the steel sheet having a coating weight of 20 g/m$^2$ to 120 g/m$^2$ per side; and a yield strength ratio is 65% or more, a tensile strength is 950 MPa or more, and Mn oxides are contained in the galvanized layer in an amount of 0.015 g/m$^2$ to 0.050 g/m$^2$.

[2] The high-yield-ratio high-strength galvanized steel sheet according to item [1], in which the composition further contains, by mass %, one or more of Mo, Cr, Cu, and Ni in a total amount of 0.1% to 0.5% and/or B: 0.0003% to 0.005%.

[3] The high-yield-ratio high-strength galvanized steel sheet according to item [1] or [2], in which the composition further contains, by mass %, Sb: 0.001% to 0.05%.

[4] The high-yield-ratio high-strength galvanized steel sheet according to any one of items [1] to [3], in which the galvanized layer is a galvannealed layer.

[5] A method for manufacturing a high-yield-ratio high-strength galvanized steel sheet, the method including a heat treatment process in which a cold-rolled steel sheet having the chemical composition according to any one of items [1] to [3] is heated to a temperature range from the Ac1 point to the Ac3 point+50° C., pickled, and subjected to a heat treatment at an average heating rate of less than 10° C./s at a heating temperature T from the Ac3 point to 950° C. with a hydrogen concentration H in a furnace atmosphere in the heating temperature range of 5 vol % or more, with a furnace dew-point D in the heating temperature range satisfying relational expression (1) below, and with a retention time in a temperature range of 450° C. to 550° C. of 5 seconds or more and less than 20 seconds, a zinc-coating process in which the steel sheet which has been subjected to the heat treatment process is subjected to a coating treatment and cooled to a temperature of 50° C. or lower at an average cooling rate of 5° C./s or more, and a skin pass rolling process in which the coated steel sheet which has been subjected to the zinc-coating process is subjected to skin pass rolling with an elongation ratio of 0.1% or more.

$$-40 \leq D \leq (T-1112.5)/7.5 \quad (1)$$

In relational expression (1), D denotes the furnace dew-point (° C.), and T denotes the heating temperature (° C.).

[6] The method for manufacturing a high-yield-ratio high-strength galvanized steel sheet according to item [5], in which the coating treatment is a galvanizing treatment or a galvanizing treatment followed by an alloying treatment.

According to the present invention, it is possible to obtain a high-yield-ratio high-strength galvanized steel sheet having a high strength represented by a tensile strength of 950 MPa or more and excellent bending workability, coatability, and appearance. Here, in accordance with embodiments of the present invention, the tensile strength is usually less than 1300 MPa.

In the case where the high-yield-ratio high-strength galvanized steel sheet according to the present invention is used for the skeleton members of an automobile body, it is possible to significantly contribute to an improvement in collision safety and weight reduction.

BRIEF DESCRIPTION OF DRAWINGS

The FIGURE is a diagram illustrating an example of an image data obtained by performing microstructure observation.

DETAILED DESCRIPTION OF EMBODIMENTS OF THE INVENTION

Hereafter, the embodiments of the present invention will be described. Here, the present invention is not limited to the embodiments described below.

<High-Yield-Ratio High-Strength Galvanized Steel Sheet>

The high-yield-ratio high-strength galvanized steel sheet according to the present invention has a steel sheet and a coating layer formed on the steel sheet. First, the steel sheet will be described. The steel sheet has a specified composition and a specified metallographic structure. The chemical composition and the metallographic structure will be described in this order.

The steel sheet has a chemical composition containing, by mass %, C: 0.12% or more and 0.25% or less, Si: less than 1%, Mn: 2.0% or more and 3% or less, P: 0.05% or less, S: 0.005% or less, Al: 0.1% or less, N: 0.008% or less, Ca: 0.0003% or less, one or more of Ti, Nb, V, and Zr in a total amount of 0.01% to 0.1%, and the balance being Fe and inevitable impurities.

In addition, the chemical composition described above may further contain, by mass %, one or more of Mo, Cr, Cu, and Ni in a total amount of 0.1% to 0.5% and/or B: 0.0003% to 0.005%.

In addition, the chemical composition described above may further contain, by mass %, Sb: 0.001% to 0.05%.

Hereafter, each of the constituent chemical elements will be described. In the description below, "%" used when describing the contents of the constituent chemical elements refers to "mass %".

C: 0.12% or More and 0.25% or Less

C, which is a chemical element effective for improving strength of a steel sheet, contributes to an improvement in strength by forming martensite containing supersaturated C. In addition, C also contributes to an improvement in strength by combining with carbide-forming chemical elements such as Nb, Ti, V, and Zr to form fine alloy compounds or alloy carbonitrides. It is necessary that the C content be 0.12% or more, preferably 0.13% or more, or more preferably 0.14% or more, in order to realize such effects. On the other hand, in the case where the C content of the present steel sheet is more than 0.25%, there is not only a significant deterioration in spot weldability but also an increase in the hardness of a steel sheet due to an increase in the amount of martensite, and there is a tendency for YR and bending workability to deteriorate. Therefore, the C content is set to be 0.12% or more and 0.25% or less. It is preferable that the C content be 0.23% or less from the viewpoint of properties.

Si: Less than 1%

Since Si is a chemical element which contributes to an improvement in strength mainly through solid solution strengthening with a comparative small decrease in ductility associated with an increase in strength, Si contributes to an improvement not only in strength but also in strength-ductility balance. On the other hand, since Si tends to form Si-based oxides in the surface layer of a steel sheet, Si may cause bare spots. Therefore, Si may be added in an amount which is necessary for achieving desired strength, and the upper limit of the Si content is set to be less than 1%, preferably 0.8% or less, or more preferably 0.5% or less, from the viewpoint of coatability. Here, it is preferable that the Si content be 0.01% or more.

Mn: 2.0% or More and 3% or Less

Mn is a chemical element which contributes to an improvement in strength through solid solution strengthening and the formation of martensite. It is necessary that the Mn content be 2.0% or more, preferably 2.1% or more, or more preferably 2.2% or more, in order to realize such an effect. On the other hand, in the case where the Mn content is more than 3%, cracking occurs in a weld zone formed by performing spot welding, and a variation in a metallographic structure tends to occur due to, for example, the segregation of Mn, which results in a deterioration in various kinds of workability. In addition, Mn tends to be concentrated in the surface layer of a steel sheet in the form of oxides or compound oxides, which may result in bare spots occurring. Therefore, the Mn content is set to be 3% or less, or preferably 2.8% or less.

P: 0.05% or Less

P is a chemical element which contributes to an improvement in the strength of a steel sheet through solid solution strengthening. However, in the case where the P content is more than 0.05%, there is deterioration in weldability and workability such as stretch flange formability. Therefore, it is preferable that the P content be 0.03% or less. Although there is no particular limitation on the lower limit of the P content, it is preferable that the P content be 0.001% or more, because there is deterioration in production efficiency and an increase in dephosphorization costs in a manufacturing process in the case where the P content is less than 0.001%. Here, it is possible to realize the effect of improving strength in the case where the P content is 0.001% or more.

S: 0.005% or Less

S is a harmful chemical element which causes hot embrittlement and which deteriorates workability of a steel sheet such as bendability by existing in steel in the form of sulfide-based inclusions. Therefore, it is preferable that the S content be as small as possible. In embodiments of the present invention, it is acceptable that the S content be 0.005% or less. Although there is no particular limitation on the lower limit of the S content, there is deterioration in production efficiency and an increase in cost in a manufacturing process in the case where the S content is less than 0.0001%. Therefore, it is preferable that the S content be 0.0001% or more.

Al: 0.1% or Less

Al is added as a deoxidizing agent. It is preferable that the Al content be 0.01% or more, or more preferably 0.02% or more, in the case where such an effect is necessary. On the other hand, in the case where the Al content is more than 0.1%, there is an increase in material costs, and excessive Al content also induces surface defects on a steel sheet. Therefore, the Al content is set to be 0.1% or less, or preferably 0.04% or less. Here, in the present invention, it is preferable that the sum of the Al content and the Si content be 0.5% or less.

N: 0.008% or Less

In the case where the N content is more than 0.008%, there is deterioration in ductility and toughness due to an excessive amount of nitrides being formed in steel, and there may be deterioration in the surface quality of a steel sheet. Therefore, the N content is set to be 0.008% or less, or preferably 0.006% or less. It is preferable that the N content be as small as possible from the viewpoint of improving ductility as a result of an improvement in the cleanliness of ferrite. On the other hand, in the case where the N content is excessively decreased, there is deterioration in production efficiency and an increase in cost in a manufacturing process. Therefore, it is preferable that the N content be 0.0001% or more.

Ca: 0.0003% or Less

Ca deteriorates the workability of a steel sheet by forming sulfides and oxides in steel. Therefore, the Ca content is set to be 0.0003% or less, or preferably 0.0002% or less. It is preferable that the Ca content is as small as possible, and the Ca content may be 0%.

One or More of Ti, Nb, V, and Zr: 0.01% to 0.1% in Total

Ti, Nb, V, and Zr combine with C and N to form precipitates in the form of carbides and nitrides (or sometimes carbonitrides). Fine precipitates contribute to an improvement in the strength of a steel sheet. In particular, the strength is improved by forming fine precipitates of these chemical elements in soft ferrite. In addition, there is also an effect of decreasing the difference in strength between ferrite and martensite, which contributes to an improvement in the workability such as bendability and stretch flange formability of a steel sheet. Moreover, since these chemical elements have a function of decreasing the grain diameter of the microstructure of a hot-rolled coil, these chemical elements contribute to an improvement in strength and workability such as bendability by decreasing the grain diameter of the microstructure (metallographic structure) of a final product sheet which has been subjected to a subsequent heat treatment following cold rolling and heating. Therefore, the total content of these chemical elements is set to be 0.01% or more, or preferably 0.02% or more. However, in the case where the total content is excessively large, there is a deterioration in productivity due to an increase in resistance to deformation when cold rolling is performed, and in the case where the amount of precipitates is excessively large or in the case where the grain diameter of precipitates is large, there is a deterioration in the ductility of ferrite and in the ductility and workability such as bendability and stretch flange formability of a steel sheet. Therefore, the total content of these chemical elements is set to be 0.1% or less, or preferably 0.08% or less.

The remainder which is different from the constituent chemical elements described above is Fe and inevitable impurities. Here, the chemical composition of the steel sheet may contain the constituent chemical elements described below.

One or More of Mo, Cr, Cu, and Ni: 0.1% to 0.5% in Total and/or B: 0.0003% to 0.005%

Since these chemical elements facilitate the formation of martensite by improving hardenability, these chemical elements contribute to an improvement in strength. It is preferable that one or more of Mo, Cr, Cu, and Ni be added in a total amount of 0.1% or more in order to realize such an effect. In addition, in the case where the total content of Mo, Cr, Cu, and Ni is excessively large, such an effect becomes saturated, and there is an increase in cost. In addition, in the case where the Cu content is excessively large, cracking occurs when hot rolling is performed, which results in surface flaws occurring. Therefore, the total content of these chemical elements is set to be 0.5% or less. Since Ni is effective for inhibiting surface flaws caused by the addition of Cu from occurring, it is preferable that Ni be added when Cu is added. It is preferable that the Ni content be ½ or more the Cu content. As described above, B also contributes to an improvement in strength by improving hardenability. In addition, the lower limit of the B content is set from the viewpoint of realizing the effect of inhibiting the formation of ferrite occurring in a cooling process for a heat treatment and from the viewpoint of improving hardenability. Specifically, it is preferable that the B content be 0.0003% or more. Since such effects become saturated in the case where the B content is excessively large, the upper limit of the B content is set. Specifically, it is preferable that the B content be 0.005% or less. In the case where hardenability is excessively high, there is also a disadvantage, for example, in that cracking occurs in a weld zone when welding is performed.

Sb: 0.001% to 0.05%

Sb is a chemical element which is effective for inhibiting deterioration in the strength of a steel sheet by inhibiting decarburization, denitrification, boron removal, and so forth. In addition, Sb is effective for inhibiting spot weld cracking. Therefore, it is preferable that the Sb content be 0.001% or more, or more preferably 0.002% or more. However, in the case where the Sb content is excessively large, there is deterioration in the workability such as stretch flange formability of a steel sheet. Therefore, it is preferable that the Sb content be 0.05% or less, or more preferably 0.02% or less.

Here, there is no decrease in the effects of the present invention in the case where the optional constituent chemical elements described above are contained in amounts less than the lower limits described above. Therefore, in the case where the optional constituent chemical elements are contained in amounts less than the lower limits described above, such optional constituent chemical elements described above are regarded as inevitable impurities.

Hereafter, the metallographic structure of the steel sheet will be described. The metallographic structure of the steel sheet includes, in terms of area ratio, 15% or less (including 0%) of ferrite, 20% or more and 50% or less of martensite, and bainite and tempered martensite in a total amount of 30% or more.

Ferrite: 15% or Less

Although it is not preferable that ferrite exist from the viewpoint of the strength of a steel sheet, it is acceptable that the area ratio of ferrite be 15% or less in embodiments of the present invention, preferably 10% or less, or more preferably 5% or less. In addition, the area ratio of ferrite may be 0%. The area ratio described above is determined by using the method described in EXAMPLES. Here, bainite which is formed at a comparatively high temperature and which does not contain carbides is regarded as ferrite without distinguishing such bainite from ferrite in the observation using a scanning electron microscope described in EXAMPLES below.

Martensite (As-Quenched Martensite): 20% or More and 50% or Less

Since martensite is hard and effective and indispensable for improving the strength of a steel sheet, the area ratio of martensite is set to be 20% or more, or preferably 25% or more, in order to achieve a tensile strength (TS) of 950 MPa or more. On the other hand, since hard martensite in the quenched state decreases YR, the upper limit of the area ratio of martensite is set to be 50% or less, or preferably 45% or less. The area ratio described above is determined by using the method described in EXAMPLES.

Bainite and Tempered Martensite: 30% or More in Total

The area ratio of bainite (meaning bainite which contains carbides, because bainite which does not contain carbides is regarded as ferrite as described above) and tempered martensite is set to be 30% or more in order to simultaneously achieve a satisfactory tensile strength and a high yield ratio (yield strength ratio). In particular, the phase fraction of bainite and tempered martensite is important in order to achieve high YS in an embodiment of the present invention, and it is preferable that the area ratio be 40% or more in order to stably achieve a high YS. Here, although there is no particular limitation on the upper limit of the area ratio, it is preferable that the upper limit be 90% or less, or more preferably 80% or less, from the viewpoint of strength-ductility (workability) balance. The area ratio described above is determined by using the method described in EXAMPLES.

Here, there may be a case where the metallographic structure of a steel sheet includes the remainder, which is different from the microstructures (phases) described above, including pearlite, retained austenite, and precipitates such as carbides, and it is acceptable that the area ratio of the remainder be 10% or less, or preferably 5% or less, in terms of total area ratio at a position located at ¼ of the thickness. The area ratio described above is determined by using the method described in EXAMPLES.

Hereafter, a galvanized layer will be described. The coating weight of the galvanized layer is set to be 20 g/m$^2$ to 120 g/m$^2$ per side. In the case where the coating weight is less than 20 g/m$^2$, it is difficult to achieve satisfactory corrosion resistance. It is preferable that the coating weight be 30 g/m$^2$ or more. On the other hand, in the case where the coating weight is more than 120 g/m$^2$, there is deterioration in exfoliation resistance. It is preferable that the coating weight be 90 g/m$^2$ or less.

In addition, Mn oxides, which are formed in a heat treatment process before a coating treatment is performed, are mixed in a galvanized layer when an Fe—Al alloy phase or an Fe—Zn alloy phase is formed as a result of a reaction between a coating bath and a steel sheet during a coating treatment, and the oxides are retained at an interface between the coating layer and the base steel in the case where the amount of the oxides is excessively large, which results in a deterioration in coating adhesiveness. Hence, it is preferable that the amount of the Mn oxides in a coating layer be as small as possible. However, it is difficult to control the amount of Mn to be less than 0.015 g/m$^2$, because this requires that the dew-point be controlled to be lower than that in a usual operation condition. In addition, the amount of Mn oxides may be 0.04 g/m$^2$ or more. In addition, in the case where the amount of Mn oxides in a coating layer is more than 0.050 g/m$^2$, sufficient reaction for forming an Fe—Al alloy phase or an Fe—Zn alloy phase does not occur, which results in bare spots occurring and a deterioration in exfoliation resistance. Therefore, the amount of Mn oxides contained in the galvanized layer is set to be 0.015 g/m$^2$ to 0.050 g/m$^2$, or preferably 0.04 g/m$^2$ or less. Here, the amount of Mn oxides in a galvanized layer is determined by using the method described in EXAMPLES.

The galvanized layer may be a galvannealed layer, which has been subjected to an alloying treatment.

<Method for Manufacturing High-Yield-Ratio High-Strength Galvanized Steel Sheet>

The manufacturing method according to embodiments of the present invention includes a heat treatment process, a galvanizing process, and a skin pass rolling process.

The heat treatment process is a process in which a cold-rolled steel sheet having the chemical composition described above is heated to a temperature range from the Ac1 point to the Ac3 point+50° C., pickled, and subjected to a heat treatment at an average heating rate of less than 10° C./s at a heating temperature T from the Ac3 point to 950° C. with a hydrogen concentration H in a furnace atmosphere in the heating temperature range of 5 vol % or more, with a furnace dew-point D satisfying relational expression (1) below, and with a retention time in a temperature range of 450° C. to 550° C. of 5 seconds or more and less than 20 seconds. Here, in the description below, the term "temperature" denotes the surface temperature of a steel sheet.

Manufacturing Slab (Cast Piece (Steel))

Steel from which a cold-rolled steel sheet used in the manufacturing method according to an embodiment of the present invention is obtained is a slab which is manufactured by using a continuous casting method. A continuous casting method is used in order to prevent the macro segregation of alloy constituent chemical elements. Steel may be manufactured by using, for example, an ingot-making method or a thin-slab casting method.

In addition, after a steel slab has been manufactured, hot rolling may be performed by using any one of a conventional method in which the slab is reheated after having been cooled to room temperature, a method in which hot rolling is performed after the slab has been charged into a heating furnace in the warm state without having been cooled to near-room temperature, a method in which hot rolling is performed immediately after the slab has been subjected to heat retention for a short time, and a method in which hot rolling is performed directly on a cast piece in the hot state.

A cold-rolled steel sheet is obtained by performing cold rolling after hot rolling has been performed on the steel described above. Although there is no particular limitation on the conditions used for hot rolling, it is preferable that steel having the chemical composition described above be heated to a temperature of 1100° C. or higher and 1350° C. or lower, subjected to hot rolling with a finishing delivery temperature of 800° C. or higher and 950° C. or lower, and coiled at a temperature of 450° C. or higher and 700° C. or lower.

Slab Heating Temperature

It is preferable that the steel slab heating temperature be 1100° C. or higher and 1350° C. or lower. This is because the grain diameter of precipitates in the steel slab tends to increase in the case where the slab-heating temperature is higher than the upper limit described above, and there may be a disadvantage in that it is difficult, for example, to achieve satisfactory strength through precipitation strengthening. In addition, this is because there may be a case where precipitates having a large grain diameter have negative effects on the formation of a microstructure in the subsequent heat treatment. On the other hand, achieving a smooth steel sheet surface by appropriately performing heating in order to remove, for example, blowholes and defects from the surface of the slab through scale off so that there is a decrease in the number of cracks and in the degree of asperity on the surface of a steel sheet is advantageous. It is preferable that the heating temperature be 1100° C. or higher in order to realize such an effect. On the other hand, in the case where the heating temperature is higher than 1350° C., since there is an increase in austenite grain diameter, there is an increase in the grain diameter of the metallographic structure of a final product, which may result in a deterioration in the strength and workability such as bendability and stretch flange formability of a steel sheet.

Hot Rolling

The steel slab obtained as described above is subjected to hot rolling including rough rolling and finish rolling. Generally, a steel slab is made into a sheet bar by performing rough rolling, and the sheet bar is made into a hot-rolled coil by performing finish rolling. In addition, there is no problem in the case where rolling is performed regardless of such a classification depending on, for example, rolling mill capacity as long as a specified size is obtained. It is preferable that hot rolling be performed under the conditions described below.

Finishing Delivery Temperature: 800° C. or Higher and 950° C. or Lower

By controlling the finishing delivery temperature to be 800° C. or higher, there is a tendency for the microstructure of a hot-rolled coil to be homogeneous. Controlling the microstructure at this stage to be homogeneous contributes to homogenizing the microstructure of a final product. In the case where a microstructure is inhomogeneous, there is deterioration in ductility and workability such as bendability and stretch flange formability. On the other hand, in the case where the finishing delivery temperature is higher than 950° C., since there is an increase in the amount of oxides (scale) formed, there is an increase in the degree of asperity of an interface between the base steel and the oxides, which may result in a deterioration in the surface quality after pickling or cold rolling has been performed. In addition, there is an increase in the crystal grain diameter of a microstructure, which may result in deterioration in the strength and workability such as bendability and stretch flange formability of a steel sheet as in the case of a steel slab.

After hot rolling has been performed as described above, for the purpose of the refinement and homogenization of a microstructure, it is preferable that cooling be started within 3 seconds after finish rolling has been performed and that cooling be performed at an average cooling rate of 10° C./s to 250° C./s in a temperature range from [finishing delivery temperature]° C. to [finishing delivery temperature−1001]° C.

Coiling Temperature: 450° C. to 700° C.

It is preferable that the temperature immediately before coiling is performed after hot rolling, that is, the coiling temperature, be 450° C. or higher from the viewpoint of forming fine precipitates such as NbC. It is preferable that the coiling temperature be 700° C. or lower, because this results in the grain diameter of precipitates being prevented from excessively increasing. It is more preferable that the coiling temperature be 500° C. or higher and 680° C. or lower from the viewpoint of, for example, obtaining a hot-rolled steel sheet having a microstructure homogeneous in terms of grain diameter.

Subsequently, cold rolling is performed. In cold rolling, the hot-rolled steel sheet which has been obtained by performing hot rolling as described above is subjected to cold rolling. Here, the hot-rolled steel sheet is usually made into a cold-rolled coil by performing cold rolling following pickling for the purpose of descaling. Such pickling is performed as needed.

It is preferable that cold rolling be performed with a rolling reduction ratio of 20% or more. This is for the purpose of forming a homogeneous and fine microstructure in the subsequent heating process. In the case where the rolling reduction ratio is less than 20%, since there may be a case where a microstructure having a large grain diameter or an inhomogeneous microstructure is formed when heating is performed, there is a risk of a deterioration in the strength and workability of a final product sheet after the subsequent heat treatment has been performed as described above. Although there is no particular limitation on the upper limit of the rolling reduction ratio, there may be a case of deterioration in productivity due to a high rolling load and deterioration in shape in the case where a high-strength steel sheet is subjected to cold rolling with a high rolling reduction ratio. It is preferable that rolling reduction ratio be 90% or less.

Subsequently, heating (heating performed in, for example, an annealing furnace, and, hereinafter, also referred to as "annealing") is performed. In this annealing process, the cold-rolled steel sheet, which has been obtained by performing cold rolling, is heated to a temperature range from the Ac1 point to the Ac3 point+50° C. Pickling is performed thereafter.

Heating to Temperature Range from Ac1 Point to Ac3 Point+50° C.

"Heating to a temperature range from the Ac1 point to the Ac3 point+50° C." is the condition for achieving high yield ratio and satisfactory coatability in a final product. It is preferable that a microstructure including ferrite and martensite be formed before the subsequent heat treatment process from the viewpoint of material properties. Moreover, it is also preferable that the oxides of, for example, Si and Mn be concentrated in the surface layer of a steel sheet through this heating process from the viewpoint of coatability. From such points of view, heating is performed to a temperature range from the Ac1 point to the Ac3 point+50° C.

Here, Ac1=751−27C+18Si−12Mn−23Cu−23Ni+24Cr+23Mo−40V−6Ti+32Zr+233Nb−169Al−895B, and Ac3=937−477C+56Si−20Mn−16Cu−27Ni−5Cr+38Mo+125V+136Ti+35Zr−19Nb+198Al+3315B, where the atomic symbols in the equations above respectively denote the contents of the corresponding chemical elements, and where the symbol of a chemical element which is not contained is assigned a value of 0.

Pickling

In order to achieve satisfactory coatability by performing heating in a temperature range equal to or higher than the Ac3 point in the subsequent heat treatment process, the oxides of, for example, Si and Mn, which have been concentrated in the surface layer of the steel sheet in the preceding processes, are removed by performing pickling.

Heat Treatment

After pickling has been performed as described above, a heat treatment is performed at an average heating rate of less than 10° C./s at a heating temperature T from the Ac3 point to 950° C. with a hydrogen concentration H in a furnace atmosphere in the heating temperature range of 5 vol % or more, with a furnace dew-point D in the heating temperature range satisfying relational expression (1) below, and with a retention time in a temperature range of 450° C. to 550° C. of 5 seconds or more and less than 20 seconds.

Average Heating Rate: Less than 10° C./s

The average heating rate is set to be less than 10° C./s in order to form a homogeneous microstructure. In addition, it is preferable that the average heating rate be 2° C./s or more from the viewpoint of inhibiting deterioration in production efficiency.

Heating Temperature (for Example, Annealing Temperature) T: from Ac3 Point to 950° C.

The furnace atmosphere is specified in order to achieve both satisfactory material properties and satisfactory coatability. In the case where the heating temperature is equal to or lower than the Ac3 point, since there is an increase in the phase fraction of ferrite in the metallographic structure which is finally formed, it is not possible to achieve the desired strength. In addition, it is not preferable that the heating temperature be higher than 950° C., because this results in deterioration in workability such as bendability and stretch flange formability due to increased crystal grain diameter. In addition, in the case where the heating temperature is higher than 950° C., since Mn and Si tend to be concentrated in the surface layer, there is deterioration in coatability. In addition, in the case where the heating temperature is higher than 950° C., since a load placed on the equipment is stably high, there may be a case where manufacturing is not possible.

Hydrogen Concentration H in Temperature Range from Ac3 Point to 950° C.: 5 vol % or More In an embodiment of the present invention, by controlling a furnace atmosphere along with the heating temperature described above, it is possible to achieve satisfactory coatability. In the case where the hydrogen concentration is less than 5 vol %, bare spots occur very often. Since the effect of hydrogen concentration becomes saturated in the case where the hydrogen concentration is more than 20 vol %, it is preferable that the upper limit of the hydrogen concentration be 20 vol %. Here, the hydrogen concentration need not be 5 vol % or more at a temperature out of the temperature range from Ac3 point to 950° C.

Dew-Point D in Temperature Range from Ac3 Point to 950° C.: within Range According to Relational Expression (1)

In addition, the furnace dew-point D specified by relational expression (1) below is an important factor for achieving satisfactory coatability. Even though the desired hydrogen concentration is achieved, in the case where the dew-point D is higher than the upper limit, since alloy chemical elements such as Mn and Si are concentrated again during annealing, bare spots and deterioration in coating quality occur. Although there is no particular limitation on the lower limit of the dew-point, there is a problem in that controlling the dew-point to be lower than −40° C. is difficult, which requires huge equipment costs and operation costs.

[Math. 1]

$$-40 \leq D \leq (T-1112.5)/7.5 \quad (1)$$

In relational expression (1), D denotes the furnace dew-point (° C.), and T denotes the heating temperature (° C.).

Retention Time in a Temperature Range of 450° C. to 550° C.: 5 Seconds or More and Less than 20 Seconds The steel sheet is held in a temperature range of 450° C. to 550° C. for 5 seconds or more before a coating process. This is for the purpose of promoting the formation of bainite. In the specification of a microstructure, bainite is an important phase for achieving high YS. It is necessary that the steel sheet be held in this temperature range for 5 seconds or more in order to form bainite and in order to control the total phase fraction of bainite and tempered martensite to be 30% or more. In addition, in the case where the retention time is more than 20 seconds in the present invention, since the transformation of austenite into bainite occurs more than necessary, it is not possible to obtain a sufficient amount of martensite. Therefore, it is necessary that the retention time be less than 20 seconds. It is not preferable that the retention temperature be lower than 450° C., because this makes it difficult to form bainite, and because this results in deterioration in the quality of the coating bath in the case where the retention temperature is lower than that of the subsequent coating bath. Hence, the lower limit of the temperature range described above is set to be 450° C. On the other hand, in the case where the retention temperature is higher than 550° C., ferrite and pearlite are more likely to be formed than bainite. It is preferable that a cooling be performed at a cooling rate (average cooling rate) of 3° C./s or more from the heating temperature to this temperature range. This is because, since ferrite transformation tends to occur in the case where the cooling rate is less than 3° C./s, it is not possible to form the desired metallographic structure. There is no particular limitation on the upper limit of the cooling rate. Although the cooling may be stopped in the above-described temperature range of 450° C. to 550° C., the steel sheet may be held in a temperature range of 450° C. to 550° C. after having been subjected to cooling to a temperature equal to or lower than the temperature range followed by reheating. In this case, there may be a case where martensite is formed and then tempered if cooling is performed to a temperature equal to or lower than the Ms point.

Subsequently, a zinc-coating process is performed. The zinc-coating process is a process in which the steel sheet, which has been subjected to the heat treatment, is subjected to a coating treatment and cooled to a temperature of 50° C. or lower at an average cooling rate of 5° C./s or more.

The coating treatment should be performed so that the coating weight is 20 g/m$^2$ to 120 g/m$^2$ per side. There is no particular limitation on other conditions. In this process, for example, a coating layer having a composition containing, by mass %, Fe: 0.1% to 18.0%, Al: 0.001% to 1.0%, one, two, or more selected from Pb, Sb, Si, Sn, Mg, Mn, Ni, Cr, Co, Ca, Cu, Li, Ti, Be, Bi, and REM in a total amount of 0% to 30%, and the balance being Zn and inevitable impurities is formed on the surface of the steel sheet obtained by the method described above. A coating method used is a galvanizing method. The coating condition may be appropriately set. In addition, an alloying treatment, in which heating is performed, may be performed after galvanizing treatment has been performed. The alloying treatment (galvannealing) is a treatment in which, for example, the galvanized steel sheet is held in a temperature range of 480° C. to 600° C. for about 1 second to 60 seconds.

After the coating treatment has been performed (after the alloying treatment has been performed in the case where the alloying treatment is performed) as described above, cooling is performed to a temperature of 50° C. or lower at an average cooling rate of 5° C./s or more. This is for the purpose of forming martensite, which is indispensable for improving strength. In the case where the average cooling rate is less than 5° C./s, it is difficult to form a sufficient amount of martensite for achieving the desired strength. In addition, in the case where cooling is stopped at a temperature of higher than 50° C., since martensite is tempered to an excessive degree (self-tempering), it is difficult to achieve the desired strength. Here, it is preferable that the average cooling rate be 30° C./s or less in order to form appropriately tempered martensite for achieving high YR.

Subsequently, skin pass rolling is performed. The skin pass rolling process is a process in which the coated steel sheet after a galvanizing treatment has been performed is subjected to skin pass rolling with an elongation ratio of 0.1% or more. Skin pass rolling is performed on the coated steel sheet with an elongation ratio of 0.1% or more for the purpose of stably achieving a high YS in addition to correcting the shape and controlling the surface roughness. Processing through the use of leveler may be performed in addition to skin pass rolling for the purpose of correcting the shape and controlling the surface roughness. In the case where skin pass rolling is performed more than necessary, since excessive strain is applied to the surface of a steel sheet, there is a decrease in the evaluation values of bendability and stretch flange formability. In addition, in the case where skin pass rolling is performed more than necessary, there is deterioration in ductility, and there is an increase in load placed on the equipment due to the high strength of the steel sheet. Therefore, it is preferable that skin pass rolling be performed with a rolling reduction ratio of 3% or less.

EXAMPLES

By preparing molten steels having the chemical compositions given in Table 1 through the use of a converter, by making the molten steels into slabs through the use of a continuous casting machine, and by performing, under the various conditions given in Table 2, hot rolling, cold rolling, heating (annealing), pickling (in the case indicated by "○" in Table 2, a pickling solution having a HCl concentration of 5 mass % and a temperature of 60° C. was used), a heat treatment, a coating treatment, and skin pass rolling, high-strength galvanized steel sheets (product sheets) were manufactured. Here, in the cooling process (cooling process after the coating treatment had been performed), the steel sheets were passed through a water tank having a temperature of 40° C. so as to be cooled to a temperature of 50° C. or lower.

TABLE 1 mass %

| Steel No. | C | Si | Mn | P | S | N | Al | Ti | Nb | V | Zr | B |
|---|---|---|---|---|---|---|---|---|---|---|---|---|
| A | 0.120 | 0.20 | 2.80 | 0.030 | 0.0010 | 0.0040 | 0.035 | 0.015 | 0.042 | | | |
| B | 0.140 | 0.10 | 2.45 | 0.008 | 0.0008 | 0.0038 | 0.030 | 0.022 | 0.020 | | | 0.0010 |
| C | 0.160 | 0.06 | 2.30 | 0.010 | 0.0009 | 0.0039 | 0.035 | 0.025 | 0.020 | | | |
| D | 0.180 | 0.02 | 2.22 | 0.010 | 0.0009 | 0.0055 | 0.035 | 0.025 | 0.020 | | | |
| E | 0.230 | 0.60 | 2.05 | 0.001 | 0.0015 | 0.0040 | 0.035 | | 0.025 | | | 0.0010 |
| F | 0.160 | 0.10 | 1.85 | 0.010 | 0.0010 | 0.0040 | 0.030 | 0.018 | 0.023 | | | 0.0010 |
| G | 0.160 | 1.20 | 2.30 | 0.010 | 0.0009 | 0.0039 | 0.030 | 0.025 | 0.020 | | | |
| H | 0.160 | 0.08 | 2.30 | 0.010 | 0.0009 | 0.0040 | 0.035 | | | | | |
| I | 0.190 | 0.50 | 2.05 | 0.001 | 0.0015 | 0.0040 | 0.035 | 0.031 | | | | 0.0010 |
| J | 0.190 | 0.50 | 2.05 | 0.001 | 0.0015 | 0.0040 | 0.035 | | | 0.051 | | |
| K | 0.190 | 0.50 | 2.05 | 0.001 | 0.0015 | 0.0040 | 0.035 | | | | 0.028 | |
| L | 0.160 | 0.06 | 2.30 | 0.010 | 0.0009 | 0.0039 | 0.035 | 0.025 | 0.020 | | | |
| M | 0.160 | 0.06 | 2.30 | 0.010 | 0.0009 | 0.0039 | 0.035 | 0.025 | 0.020 | | | |
| N | 0.160 | 0.06 | 2.30 | 0.010 | 0.0009 | 0.0039 | 0.035 | 0.025 | 0.020 | | | |

| Steel No. | Mo | Cr | Cu | Ni | Sb | Ca | AC1 (° C.) | AC3 (° C.) | Note |
|---|---|---|---|---|---|---|---|---|---|
| A | | | | | | 0.0001 | 722 | 843 | Example |
| B | 0.10 | | | | | | 720 | 842 | Example |
| C | 0.12 | | | | | 0.0001 | 722 | 833 | Example |
| D | 0.12 | | | | | 0.0001 | 721 | 822 | Example |
| E | | | | | | | 730 | 830 | Example |
| F | 0.10 | 0.1 | | | | 0.0001 | 730 | 844 | Comparative Example |
| G | 0.12 | | | | | | 743 | 895 | Comparative Example |
| H | 0.10 | | | | | 0.0001 | 717 | 830 | Comparative Example |
| I | | | | | | | 723 | 848 | Example |
| J | | | | | | | 722 | 847 | Example |
| K | | | | | | | 725 | 841 | Example |

TABLE 1-continued

| | | | | | | | | | mass % |
|---|---|---|---|---|---|---|---|---|---|
| | L | 0.18 | | | | | 723 | 827 | Example |
| | M | | 0.10 | 0.05 | | | 715 | 825 | Example |
| | N | | | | 0.004 | | 719 | 828 | Example |

*Underlined portions indicate values out of the range of the present invention.

TABLE 2

| | | Hot Rolling | | | | | | Heat Treatment | |
|---|---|---|---|---|---|---|---|---|---|
| No. | Steel No. | Slab Heating Temperature (° C.) | Finishing Delivery Temperature (° C.) | Coiling Temperature (° C.) | Cold Rolling Cold Rolling Reduction Ratio (%) | Heating Temperature ° C. | Pickling Done or Undone | Average Heating Rate (° C./s) | Temperature T (° C.) |
| 1 | A | 1280 | 920 | 520 | 60 | 840 | ○ | 5 | 870 |
| 2 | B | 1150 | 840 | 580 | 50 | 820 | ○ | 7 | 870 |
| 3 | C | 1200 | 880 | 550 | 50 | 840 | ○ | 5 | 850 |
| 4 | D | 1230 | 900 | 600 | 40 | 850 | ○ | 5 | 860 |
| 5 | E | 1250 | 860 | 620 | 30 | 820 | ○ | 3 | 860 |
| 6 | F | 1200 | 880 | 560 | 50 | 820 | ○ | 5 | 850 |
| 7 | G | 1220 | 890 | 560 | 50 | 820 | ○ | 5 | 900 |
| 8 | H | 1180 | 890 | 560 | 50 | 820 | ○ | 5 | 850 |
| 9 | C | 1200 | 880 | 550 | 50 | 840 | ○ | 5 | 865 |
| 10 | C | 1200 | 880 | 550 | 50 | 840 | ○ | 5 | 850 |
| 11 | C | 1200 | 880 | 550 | 50 | 840 | ○ | 5 | 850 |
| 12 | C | 1200 | 880 | 550 | 50 | 700 | ○ | 5 | 850 |
| 13 | C | 1200 | 880 | 550 | 50 | 840 | ○ | 5 | 850 |
| 14 | C | 1200 | 880 | 550 | 50 | 840 | ○ | 5 | 760 |
| 15 | C | 1200 | 880 | 550 | 50 | 840 | X | 5 | 850 |
| 16 | E | 1200 | 860 | 600 | 50 | 820 | ○ | 3 | 860 |
| 17 | I | 1300 | 830 | 600 | 50 | 820 | ○ | 4 | 860 |
| 18 | J | 1200 | 900 | 600 | 50 | 820 | ○ | 4 | 860 |
| 19 | K | 1260 | 850 | 600 | 50 | 820 | ○ | 4 | 860 |
| 20 | L | 1200 | 880 | 550 | 50 | 840 | ○ | 5 | 850 |
| 21 | M | 1200 | 880 | 550 | 50 | 840 | ○ | 5 | 850 |
| 22 | N | 1200 | 880 | 550 | 50 | 840 | ○ | 5 | 850 |

| | Heat Treatment | | | after Coating Treatment | Skin Pass | |
|---|---|---|---|---|---|---|
| No. | Hydrogen Concentration (vol. %) | Dew-point D ° C. | Retention Time *2 (s) | Average Cooling Rate *1 (° C./s) | Rolling Elongation Ratio (%) | Note |
| 1 | 5 | −34 | 15 | 8 | 0.15 | Example |
| 2 | 12 | −37 | 12 | 10 | 0.2 | Example |
| 3 | 8 | −38 | 15 | 10 | 0.3 | Example |
| 4 | 10 | −36 | 15 | 20 | 0.3 | Example |
| 5 | 15 | −36 | 10 | 10 | 0.3 | Example |
| 6 | 8 | −37 | 15 | 10 | 0.3 | Comparative Example |
| 7 | 8 | −37 | 15 | 10 | 0.3 | Comparative Example |
| 8 | 8 | −37 | 15 | 10 | 0.3 | Comparative Example |
| 9 | 8 | −35 | 15 | 10 | 0.3 | Example |
| 10 | 3 | −38 | 15 | 10 | 0.3 | Comparative Example |
| 11 | 8 | −10 | 15 | 10 | 0.3 | Comparative Example |
| 12 | 8 | −38 | 10 | 10 | 0.3 | Comparative Example |
| 13 | 8 | −38 | 4 | 25 | 0.3 | Comparative Example |
| 14 | 8 | *3 | 15 | 10 | 0.3 | Comparative Example |
| 15 | 8 | −38 | 15 | 10 | 0.3 | Comparative Example |
| 16 | 15 | −36 | 10 | 1 | 0.3 | Comparative Example |
| 17 | 15 | −36 | 10 | 10 | 0.3 | Example |
| 18 | 15 | −36 | 10 | 10 | 0.3 | Example |
| 19 | 15 | −36 | 10 | 10 | 0.45 | Example |

TABLE 2-continued

| | | | | | | |
|---|---|---|---|---|---|---|
| 20 | 8 | −38 | 15 | 10 | 0.3 | Example |
| 21 | 8 | −38 | 15 | 10 | 0.3 | Example |
| 22 | 8 | −38 | 15 | 10 | 0.3 | Example |

*Underlined portions indicate values out of the range of the present invention.

*1 Average cooling rate after coating treatment: a temperature ange is 450° C. to 50° C., in which a temperature of 50° C. is reached after the steel sheet has passed through the last cooling zone as a result of the steel sheet being passed through a water tank having a temperature of 40° C. so as to be cooled to a temperature of 50° C. or lower.

*2 This refers to a retention time in a temperature ange of 450° C. to 550° C.

*3 A case of a heating treatment temperature T be ng out of the temperature range in which the dew-point D is specified By taking samples from the galvanized steel sheets obtained as described above, and by performing microstructure observation and a tensile test through the use of the methods described below, phase fraction (area ratio) of a metallographic structure, yield strength (YS), tensile strength (TS), and yield strength ratio (YR=YS/TS×100%) were determined or calculated. In addition, by performing visual observation on appearance, coatability (surface quality) was evaluated. The evaluation methods are as follows.

Microstructure Observation

By taking a sample for microstructure observation from the galvanized steel sheet, by polishing an L-cross section (thickness cross section parallel to the rolling direction), by etching the polished cross section through the use of a nital solution, by performing observation through the use of a SEM at a magnification of 1500 times in 3 or more fields of view in the vicinity of a position located ¼t (t denotes a whole thickness) from the surface in the etched cross section in order to obtain image data, and by performing image analysis on the obtained image data, area ratio was determined for each of the observed fields of view, and average value of the determined area ratios was calculated. Here, an example of the image data described above is given in the FIGURE.

Amount of Mn Oxides in Galvanized Layer

The amount of Mn oxides in a galvanized layer was determined by dissolving the coating layer in dilute hydrochloric acid and by performing ICP emission spectrometry. The specific measuring principle will be described below. Most of the Mn oxides, which are formed in the surface layer of the steel sheet in an annealing process, are mixed in the coating layer in a coating process, and some of the oxides are retained at an interface between the coating layer and the base steel. Since it is possible to easily dissolve Mn oxides in acid, by immersing a coated steel sheet in dilute hydrochloric acid, it is possible to dissolve all the Mn oxides existing in the coating layer and retained at the interface. At this time, by adding an inhibitor in the dilute hydrochloric acid, since it is possible to inhibit the dissolution of the steel sheet, it is possible to accurately determine only the amount of Mn oxides which are formed in the surface layer of the steel sheet.

Tensile Test

A tensile test was performed with a constant tensile speed (crosshead speed) of 10 mm/min on a JIS No. 5 tensile test piece (JIS Z 2201) taken from the galvanized steel sheet in a direction rectangular to the rolling direction. The yield strength (YS) was defined as 0.2%-proof stress which was derived from the inclination in the elastic range corresponding to a strain of 100 MPa to 200 MPa, and the tensile strength was defined as the maximum load in the tensile test divided by the initial cross-sectional area of the parallel part of the test piece. When the cross-sectional area of the parallel part was calculated, the thickness was defined as the thickness including that of the coating layer.

Surface Quality (Appearance)

By performing visual observation on the appearance after a coating treatment had been performed, a case where no bare spot was observed was judged as ○, a case where bare spots were observed was judged as ×, a case where no bare spot was observed but, for example, a variation in coating appearance was observed was judged as Δ. Here, the term "bare spots" denotes areas having a size of about several micrometers to several millimeters in which no coating layer exists so that the steel sheet is exposed.

Exfoliation Resistance

Regarding exfoliation resistance when bending is performed, (1) GA (which has been subjected to alloying treatment) is required to have such exfoliation resistance that separation is inhibited at a position which is subjected to bending work at an angle of more than 90° to make an acute angle. In the present examples, by sticking a cellophane tape to a portion which had been subjected to bending at an angle of 120°, and by thereafter peeling the cellophane tape so that separated objects moved to the cellophane tape, the amount of separated objects on the cellophane tape was determined in terms of Zn count number obtained by performing X-ray fluorescence spectrometry. Here, at this time, the mask diameter was 30 mm, the acceleration voltage for the fluorescent X-rays was 50 kV, the acceleration current was 50 mA, and the measuring time was 20 seconds. On the basis of the standard below, a case of rank 1 or 2 was judged as a case of good exfoliation resistance (denoted by the symbol ○), a case of rank 3 or higher was judged as a case of poor exfoliation resistance (denoted by the symbol ×).

Rank by Zn count number with fluorescent X-ray 0 or more and less than 500: 1

500 or more and less than 1000: 2

1000 or more and less than 2000: 3

2000 or more and less than 3000: 4

3000 or more: 5

(2) GI (which has not been subjected to an alloying treatment) is required to have exfoliation resistance when an impact test is performed. By performing a ball impact test, by performing a tape peeling test on a portion which had been subjected to processing, and by performing a visual observation, whether or not coating-layer separation occurred was investigated. The ball impact test was performed with a ball weight of 1000 g and with a falling height of 100 cm.

○ (Good): without coating-layer separation

× (NG): with coating-layer separation

Corrosion Resistance After Processing

Chemical conversion treatment was performed on GA, which had been subjected to bending at an angle of 120°, and GI, which had been subjected a ball impact test, so that the coating weight of the chemical conversion film was 1.7 $g/m^2$ to 3.0 $g/m^2$ under the standard conditions below by using a degreasing agent: FC-E2011, a surface conditioning agent: PL-X, and chemical conversion agent: PALBOND PB-L3065 (the three agents are produced by Nihon Parkerizing Co., Ltd.).

<Standard Condition>

Degreasing process: treatment temperature of 40° C. and treatment time of 120 seconds Spray degreasing and surface conditioning process: pH of 9.5, treatment temperature of room temperature, and treatment time of 20 seconds Chemical conversion treatment process: temperature of chemical conversion solution of 35° C. and treatment time of 120 seconds Electrodeposition coating was performed on the surface of the test piece, which had been subjected to the chemical conversion treatment as described above, so that the thickness of the film was 25 μm by using an electrodeposition paint: V-50 (produced by Nippon Paint Co., Ltd.), and the coated test piece was subjected to the corrosion test described below.

<Salt Spray Test (SST)>

The surface of the test piece described above, which had been subjected to bending (in the case of GA) or ball impact test (in the case of GI), and which had been subjected to the chemical conversion treatment and the electrodeposition coating, was cut by using a cutter knife so that the cut flaw reached the coating layer. This test piece was subjected to a salt spray test by using a 5 mass % NaCl aqueous solution for 240 hours in accordance with the neutral salt spray test prescribed in JIS Z 2371:2000. By performing a tape peeling test on the cross-cut portion, the maximum total separation width, which was the sum of the widths on both sides of the cut line portion, was determined. A case where the maximum total separation width was 2.0 mm or less was judged as a case of good corrosion resistance in the salt spray test.

○ (Good): maximum total separation width from each cut line was 2.0 mm or less

× (NG): maximum total separation width from each cut line was more than 2.0 mm

The obtained results are given in Table 3. Here, regarding the phases in a metallographic structure, the symbol "F" denotes ferrite and bainite which does not contain carbides, the symbol "M" denotes martensite, and the symbol "M', B" denotes tempered martensite and bainite.

Workability (Bendability)

A bending test was performed in order to investigate whether or not satisfactory workability was achieved. In this test, by taking a strip-shaped sample of 30 mm (L)×100 mm (W) in a direction perpendicular to the rolling direction from the galvanized steel sheets, by polishing the end surfaces of the sample in order to obtain a test piece of 25 mm (L)×100 mm (W), by performing U-bend test on the test piece at an angle of 180° with a bending radius R of 3.5 (R/t=2.5), whether or not a crack occurred in the vicinity of the bending ridge line was investigated. The symbol "○" in the table denotes a case with no crack. Here, the term "crack" denotes a crack which is visually identifiable when observation is performed by using a microscope at a magnification of 10 times, and a wrinkle, which is formed before a crack occurs, is not regarded as a crack.

TABLE 3

| | | Metallographic Structure | | | Amount of Mn Oxides in Galvanized | Product Sheet | | | Coating Layer | |
|---|---|---|---|---|---|---|---|---|---|---|
| No. | Steel No. | F % | M % | M' B % | layer g/m$^2$ | TS MPa | YS MPa | YR % | Kind | Coating Weight g/m$^2$ |
| 1 | A | 10 | 40 | 50 | 0.050 | 955 | 655 | 69 | GA | 60 |
| 2 | B | 5 | 25 | 70 | 0.040 | 985 | 716 | 73 | GI | 46 |
| 3 | C | 5 | 45 | 50 | 0.035 | 1005 | 745 | 74 | GI | 45 |
| 4 | D | 2 | 35 | 60 | 0.025 | 1000 | 725 | 73 | GI | 47 |
| 5 | E | 3 | 50 | 45 | 0.020 | 1145 | 770 | 67 | GI | 48 |
| 6 | F | 20 | 15 | 65 | 0.030 | 940 | 625 | 66 | GI | 45 |
| 7 | G | 11 | 45 | 40 | 0.055 | 955 | 625 | 65 | GI | 40 |
| 8 | H | 15 | 35 | 50 | 0.030 | 930 | 595 | 64 | GI | 46 |
| 9 | C | 5 | 45 | 50 | 0.035 | 990 | 725 | 73 | GA | 48 |
| 10 | C | 5 | 45 | 50 | 0.030 | 995 | 710 | 71 | GI | 15 |
| 11 | C | 5 | 45 | 50 | 0.125 | 995 | 735 | 74 | GI | 140 |
| 12 | C | 35 | 20 | 45 | 0.075 | 880 | 540 | 61 | GI | 45 |
| 13 | C | 8 | 70 | 20 | 0.035 | 1205 | 745 | 62 | GI | 45 |
| 14 | C | 30 | 65 | 5 | 0.035 | 770 | 480 | 62 | GI | 45 |
| 15 | C | 5 | 55 | 40 | 0.080 | 980 | 705 | 72 | GI | 15 |
| 16 | E | 40 | 5 | 50 | 0.020 | 780 | 700 | 90 | GI | 48 |
| 17 | I | 4 | 30 | 65 | 0.020 | 990 | 725 | 73 | GI | 48 |
| 18 | J | 3 | 30 | 65 | 0.020 | 975 | 730 | 75 | GI | 48 |
| 19 | K | 3 | 30 | 65 | 0.020 | 980 | 750 | 77 | GI | 48 |
| 20 | L | 2 | 45 | 50 | 0.020 | 990 | 715 | 72 | GI | 45 |
| 21 | M | 5 | 35 | 60 | 0.035 | 995 | 730 | 73 | GI | 45 |
| 22 | N | 5 | 45 | 50 | 0.035 | 1005 | 750 | 75 | GI | 45 |

| No. | Surface Quality | Bendability | Exfoliation resistance in Processing | Corrosion Resistance after Processing | Note |
|---|---|---|---|---|---|
| 1 | Δ | ○ | ○ | ○ | Example |
| 2 | ○ | ○ | ○ | ○ | Example |
| 3 | ○ | ○ | ○ | ○ | Example |
| 4 | ○ | ○ | ○ | ○ | Example |
| 5 | ○ | ○ | ○ | ○ | Example |
| 6 | ○ | ○ | ○ | ○ | Comparative Example |
| 7 | X | ○ | X | X | Comparative Example |

TABLE 3-continued

| | | | | | |
|---|---|---|---|---|---|
| 8 | ○ | ○ | ○ | ○ | Comparative Example |
| 9 | ○ | ○ | ○ | ○ | Example |
| 10 | ○ | ○ | ○ | X | Comparative Example |
| 11 | X | ○ | X | X | Comparative Example |
| 12 | X | ○ | X | X | Comparative Example |
| 13 | ○ | ○ | ○ | ○ | Comparative Example |
| 14 | ○ | ○ | ○ | ○ | Comparative Example |
| 15 | X | ○ | X | X | Comparative Example |
| 16 | ○ | ○ | ○ | ○ | Comparative Example |
| 17 | ○ | ○ | ○ | ○ | Example |
| 18 | ○ | ○ | ○ | ○ | Example |
| 19 | ○ | ○ | ○ | ○ | Example |
| 20 | ○ | ○ | ○ | ○ | Example |
| 21 | ○ | ○ | ○ | ○ | Example |
| 22 | ○ | ○ | ○ | ○ | Example |

*Underlined portions indicate values out of the range of the present invention.

The steel sheets of the examples of the present invention, which were manufactured with chemical compositions and manufacturing conditions within the range according to embodiments of the present invention, were steel sheets having a TS of 950 MPa or more, a YR of 65% or more, the specified workability, and coating quality.

Since the galvanized steel sheet according to embodiments of the present invention has not only a high tensile strength but also a high yield strength ratio and good workability and surface quality, the steel sheet contributes to environment conservation, for example, from the viewpoint of $CO_2$ emission by contributing to an improvement in safety performance and to a decrease in the weight of an automobile body through an improvement in strength and a decrease in thickness, in the case where the steel sheet is used for the skeleton parts, in particular, for the parts around a cabin, which has an influence on collision safety, of an automobile body. In addition, since the steel sheet has both good surface quality and coating quality, it is possible to actively use for parts such as chassis which are prone to corrosion due to rain or snow, and it is also possible to expect an improvement in the rust prevention capability and corrosion resistance of an automobile body. A material having such properties can effectively be used not only for automotive parts but also in the industrial fields of civil engineering, construction, and home electrical appliances.

The invention claimed is:

1. A high-yield-ratio high-strength galvanized steel sheet comprising a steel sheet having a composition consisting of, by mass %, C: 0.12% or more and 0.25% or less, Si: 0.02% or more and 0.6% or less, Mn: 2.0% or more and 3% or less, P: 0.05% or less, S: 0.005% or less, Al: 0.1% or less, N: 0.008% or less, Ca: 0.0003% or less, one or more of Ti, Nb, V, and Zr in a total amount of 0.01% to 0.1%, optionally one or more of Mo, Cu, and Ni in a total amount of 0.1% to 0.5% and/or B: 0.0003% to 0.005%, optionally Sb: 0.001% to 0.05%, and the balance being Fe and inevitable impurities, and a metallographic structure including, in terms of area ratio, 15% or less of ferrite, 20% or more and 50% or less of martensite, bainite and tempered martensite in a total amount of 30% or more and 70% or less, and 4% or less of remainder phases including pearlite, retained austenite, and precipitates, and a galvanized layer formed on the steel sheet having a coating weight of 20 g/m$^2$ to 120 g/m$^2$ per side; and a yield strength ratio is 65% or more, a tensile strength is 950 MPa or more, and Mn oxides are contained in the galvanized layer in an amount of 0.015 g/m$^2$ to 0.040 g/m$^2$, wherein the galvanized steel sheet has a maximum total separation width of 2.0 mm or less, after being subjected to bending at an angle of 120°, a chemical conversion treatment, and an electrodeposition treatment, and followed by being subjected to a salt spray test by using a 5 mass % NaCl aqueous solution for 240 hours in accordance with the neutral salt spray test prescribed in JIS Z 2371:2000.

2. The high-yield-ratio high-strength galvanized steel sheet according to claim 1, wherein the galvanized layer is a galvannealed layer.

3. A method for manufacturing a high-yield-ratio high-strength galvanized steel sheet of claim 1, the method including a heat treatment process in which a cold-rolled steel sheet having the chemical composition according to claim 1 is heated to a temperature range from the Act point to the Ac3 point+50° C., pickled, and subjected to a heat treatment at an average heating rate of less than 10° C./s at a heating temperature T from the Ac3 point to 950° C. with a hydrogen concentration H in a furnace atmosphere in the heating temperature range of 5 vol % or more, with a furnace dew-point D in the heating temperature range satisfying relational expression (1) below, and with a retention time in a temperature range of 450° C. to 550° C. of 5 seconds or more and less than 20 seconds, a galvanizing process in which the steel sheet which has been subjected to the heat treatment process is subjected to a coating treatment and cooled to a temperature of 50° C. or lower at an average cooling rate of 5° C./s or more, and a skin pass rolling process in which the coated steel sheet which has been subjected to the galvanizing process is subjected to skin pass rolling with an elongation ratio of 0.1% or more:

$$-40 \leq D \leq (T-1112.5)/7.5 \quad (1),$$

where, in relational expression (1), D denotes the furnace dew-point (° C.), and T denotes the heating temperature (° C.), $$\text{wherein } Ac3=937-477C+56Si-20Mn-16Cu-27Ni-5Cr+38Mo+125V+136Ti+35Zr-19Nb+198Al+3315B \quad (2)$$

where the atomic symbols in relational expression (2) denote the contents of the corresponding chemical elements, and where the symbol of a chemical element which is not contained is assigned a value of 0.

4. The method for manufacturing a high-yield-ratio high-strength galvanized steel sheet according to claim 3, wherein the galvanizing treatment is a hot-dip galvanizing treatment or a hot-dip galvanizing treatment followed by an alloying treatment.

* * * * *